US005683228A

United States Patent [19]

Beatty

[11] Patent Number: 5,683,228

[45] Date of Patent: Nov. 4, 1997

[54] OIL PUMP CAVITATION RELIEF

[75] Inventor: David J. Beatty, Normal, Ill.

[73] Assignee: Caterpillar Inc., Peoria, Ill.

[21] Appl. No.: 634,576

[22] Filed: Apr. 18, 1996

[51] Int. Cl.[6] ..... F04B 1/12

[52] U.S. Cl. ..... 417/269; 92/57

[58] Field of Search ..... 417/269; 92/57, 92/71; 91/499

[56] References Cited

U.S. PATENT DOCUMENTS

| | | | |
|---|---|---|---|
| 3,249,061 | 5/1966 | Ricketts | 103/162 |
| 3,461,809 | 8/1969 | Budecker | 103/174 |
| 3,508,466 | 4/1970 | Tyler | 92/472 |
| 3,823,557 | 7/1974 | Van Wagenen | 60/325 |
| 4,469,055 | 9/1984 | Caswell | 123/78 |
| 5,131,319 | 7/1992 | Ono et al. | 92/71 |
| 5,538,401 | 7/1996 | Schaffner et al. | 417/269 |
| 5,593,285 | 1/1997 | Watts | 417/269 |

FOREIGN PATENT DOCUMENTS

| | | |
|---|---|---|
| 904664 | 7/1972 | Canada . |
| 1 964 362 | 7/1970 | Germany . |
| DL136-285 | 6/1979 | Germany . |

*Primary Examiner*—Charles G. Freay
*Attorney, Agent, or Firm*—J. W. Keen

[57] ABSTRACT

A variable displacement pump has a fluid passageway formed through a swash plate fluidly communicating a piston chamber with a drive shaft chamber not later than when the piston chamber comes into open fluid communication with a valve blcok resident inlet port to prevent erosion of the swash plate and the valve block about the inlet port. Secondary port portions of reduced flow area per unit rotation communicate with and circumferentially lead primary port portions of greater flow area per unit rotation.

9 Claims, 4 Drawing Sheets

A
D
17
16
12
14
66
22
2
10
30
18
26
24
28
42
29
21
20
B
2

OIL PUMP CAVITATION RELIEF

TECHNICAL FIELD

The present invention relates to the prevention of cavitation at the swash plate and inlet port of a variable displacement pump.

BACKGROUND ART

Variable displacement pumps are well known in the art and provide variable volumetric flow rates of fluid by rotatably driving a piston block having a plurality of pistons respectively reciprocatably arranged in piston chambers and engaged at one end with a swash plate which can be angularly displaced to control the displacement volume of the pistons and, thus, the fluid flow rates between the piston chambers and inlet and outlet ports which are periodically alignable therewith during piston block rotation.

It has been discovered, however, that in the operation of such pumps, cavitation sometimes occurs causing undesirable erosion at the swash plate and at the inlet port due primarily to temporary, albeit substantial, pressure oscillations at those locations between the inlet port's fluid pressure and the pressure in the piston chambers just prior to them being fluidly connected with the inlet port.

The present invention is directed to overcome the problems as set forth above.

DISCLOSURE OF THE INVENTION

A variable displacement pump has a drive shaft positioned within a first chamber, a swash plate having a control surface, a plurality of pistons respectively arranged within piston chambers formed in a piston block and engaged with the control surface, and a valve block having an inlet and outlet port each being communicatable during its alignment with each piston chamber. Each piston has a passageway therein providing communication between its respective piston chamber and the control surface.

The swash plate has a passageway with first and second ends which respectively open to the first chamber and the control surface to provide fluid communication therebetween. Fluid communication is thus provided between the first chamber and each piston's chamber when the corresponding piston passageway is aligned with the swash plate passageway's second end.

Each of the inlet and outlet ports of the valve block have a primary portion which includes a leading edge and a respective area per unit rotation of a preselected magnitude. The inlet and outlet ports also each includes a secondary portion which extends through the valve block, respectively communicates with the leading edge of its corresponding primary portion, has a leading edge, and has an area per unit rotation of less magnitude than the respective preselected magnitude. The second end of the swash plate passageway and the inlet port are cooperatively arranged to substantially simultaneously align with each piston chamber passageway and that piston chamber, respectively.

BEST MODE FOR CARRYING OUT THE INVENTION

Figure 1:
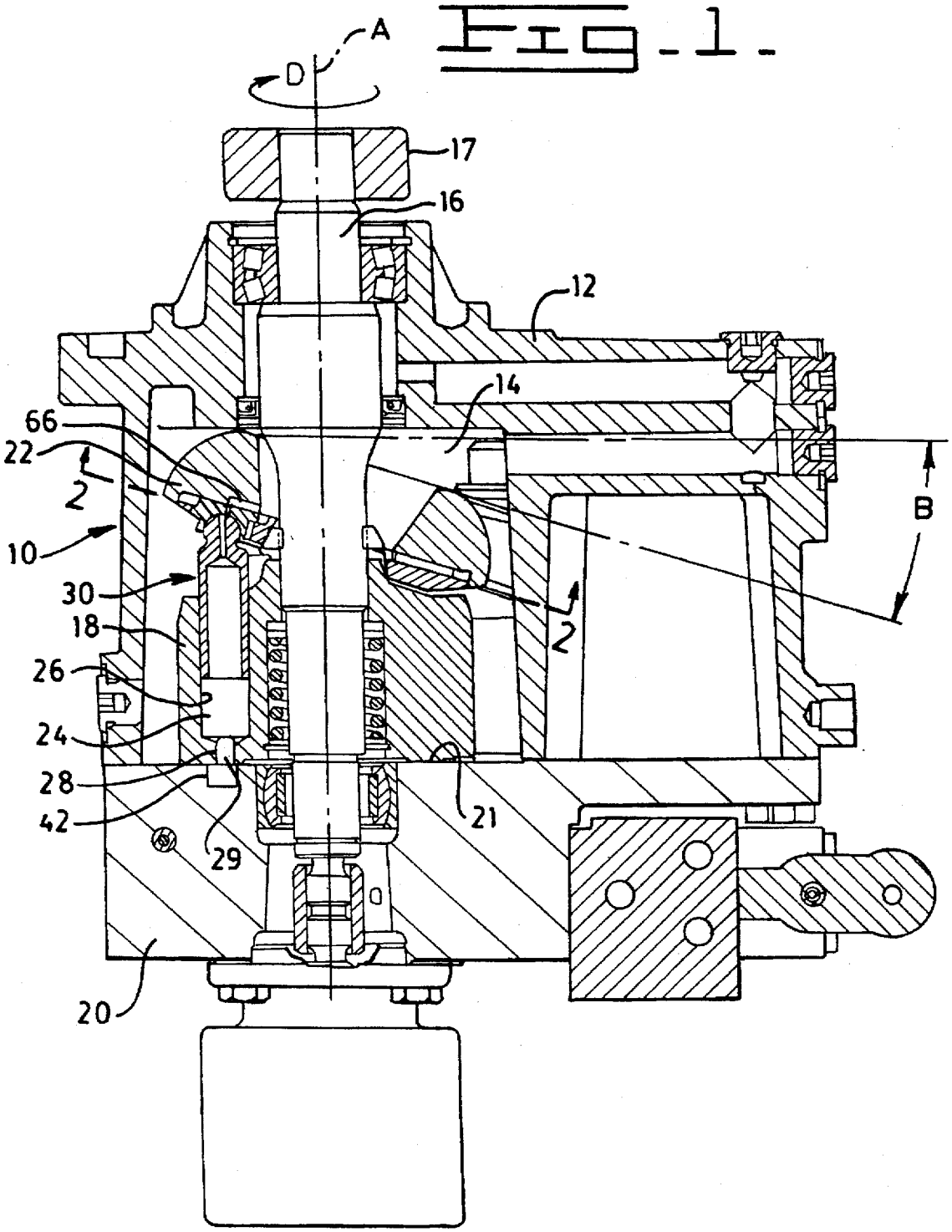
FIG. 1 is a diagrammatic frontal view in partial section of a pump made in accordance with this invention.

As used herein: "align" or other forms thereof means fluid communication between the referenced members is enabled; "leading edge" means the first part of a port to be exposed to another referenced member/opening; and "open fluid communication" means no significant restriction against fluid movement between the referenced members.

Referring now to the drawing in detail, a variable displacement pump 10 is illustrated and is seen to include a housing 12, a first chamber 14 enclosed within the housing 12, a drive shaft 16 positioned within the first chamber 14 and having an axis of rotation A, a gear 17 fixedly attached to the drive shaft 16 and being rotatably driveable by another gear (not shown), a piston block 18 which is rotatably driven by the drive shaft 16 generally about axis A, a valve block 20 illustratively arranged at one end of the piston block 18 and having a communicating surface 21, and a swash plate 22 arranged at the other end of the piston block 18.

Figure 2:
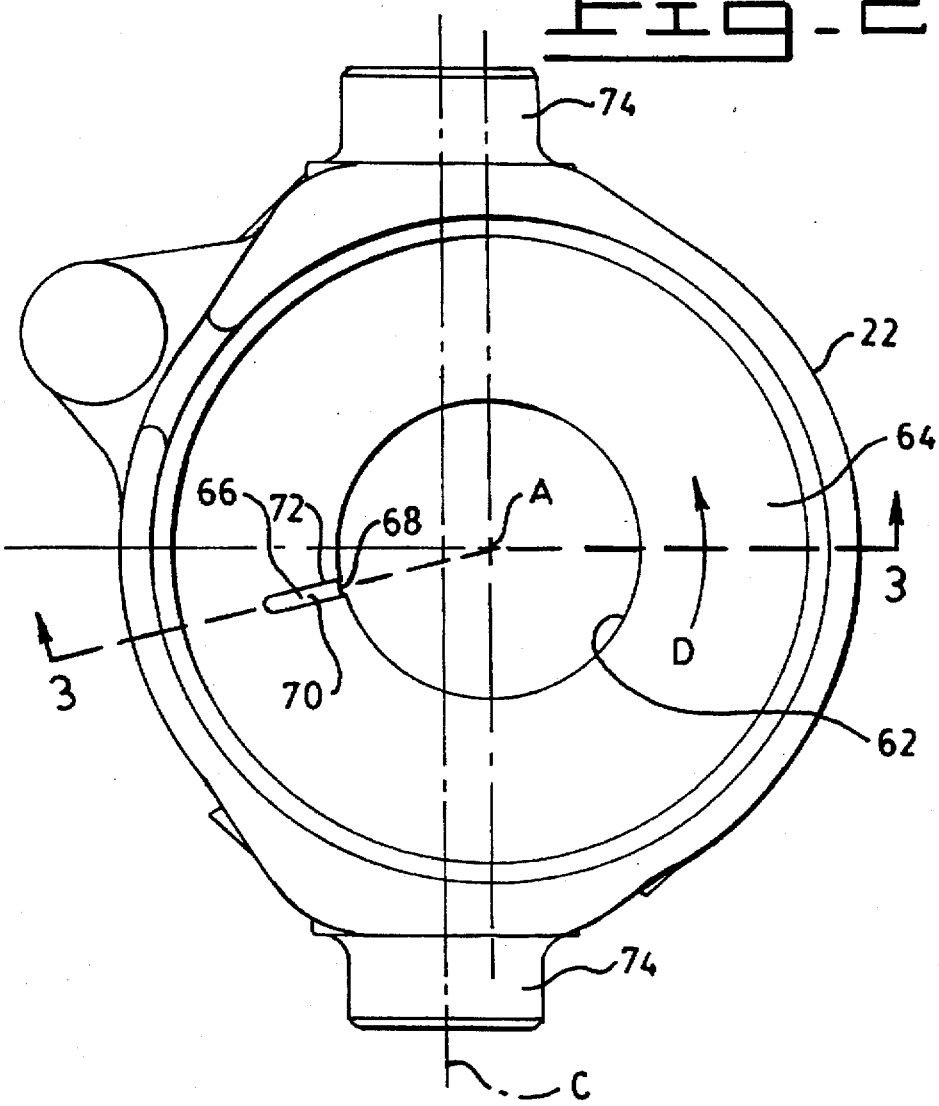
FIG. 2 is plan view of the swash plate of the pump shown in FIG. 1 as viewed from the perspective of lines II—II of FIG. 1.
Figure 4:
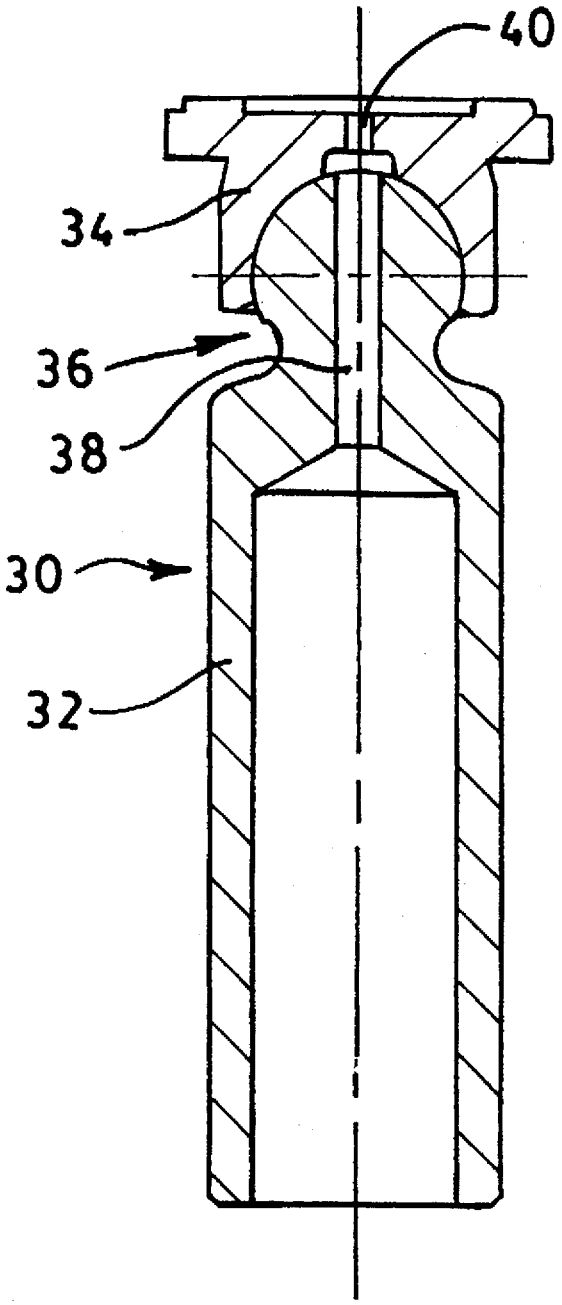
FIG. 4 is an enlarged, sectioned view of the piston shown in FIG. 1.

The piston block 18 has a plurality of piston chambers 24 (only one of which is shown in FIG. 1 due to the section plane chosen as best seen in FIG. 2 ) circumferentially spaced about the drive shaft 16. Each piston chamber 24 has a guide portion 26 and a connection portion 28. Each guide portion 26 reciprocatably houses a piston 30 which, as better illustrated in FIG. 4, includes a plunger 32 and a shoe 34 preferably connected through the illustrated ball and socket connection. While the connection portion 28 is preferably kidney shaped and has a leading edge 29 which, from the perspective of FIG. 1, is preferably disposed below (i.e. into the paper) the section plane, it is to be understood that the trailing edge (not shown due to the section plane's selection) thereof occurs above the section plane. It is to be further understood that the connection portion 28 of each piston chamber 24 is fluidly isolated from the connection portion 28 of all other piston chambers 24. A piston passageway 36 extends between the ends of each piston 30 and includes a plunger passageway 38 and a shoe passageway 40 which remain in fluid communication for all possible operational positions of the plunger 32 and shoe 34.

Figure 5:
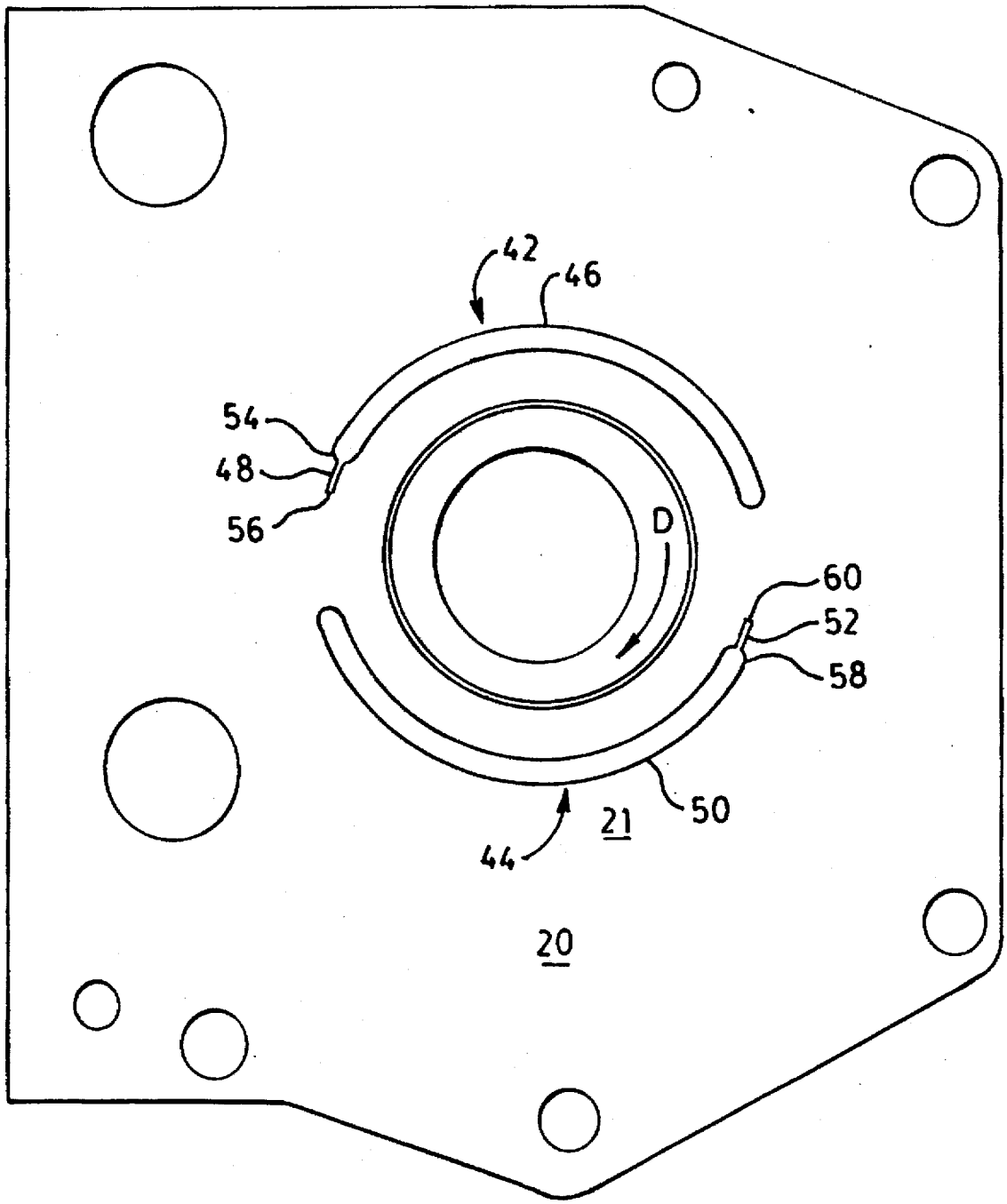
FIG. 5 is a plan view of the valve block of the pump shown in FIG. 1 illustrating the inlet and outlet ports.

The valve block 20, as better seen in FIG. 5, respectively routes working fluid to and from the piston chambers 24 through an inlet port 42 and an outlet port 44. The inlet port 42 includes a generally kidney-shaped primary portion 46 and a generally rectangular-shaped secondary portion 48 and the outlet port 44 includes a generally kidney-shaped primary portion 50 and a generally rectangular-shaped secondary portion 52. The aforementioned shapes are observed from the perspective of viewing FIG. 5. The primary and secondary portions of each port are in open fluid communication. The inlet port's primary and secondary portions have respective leading edges 54 and 56 and the outlet port's primary and secondary portions have respective leading edges 58 and 60. The secondary portions 48,52 each have a lower bounding surface which extends from the secondary portion's leading edge 56,60 toward the corresponding primary portion at an angle of inclination relative to the communicating surface 21 of between 10 and 20 degrees. The leading edges 54 and 58 each have a cross sectional flow area per unit of rotation (as measured about axis A in FIG. 5) of a first preselected magnitude while the leading edges 56 and 60 each have a cross sectional flow area per unit of rotation (as measured in FIG. 5) of a second preselected magnitude which is less than the respective first preselected magnitude. The flow area of each secondary portion 48,52 is in the range of about 1.0 to 2.0 percent of the flow area of each respective, corresponding primary portion 46,50.

Figure 3:
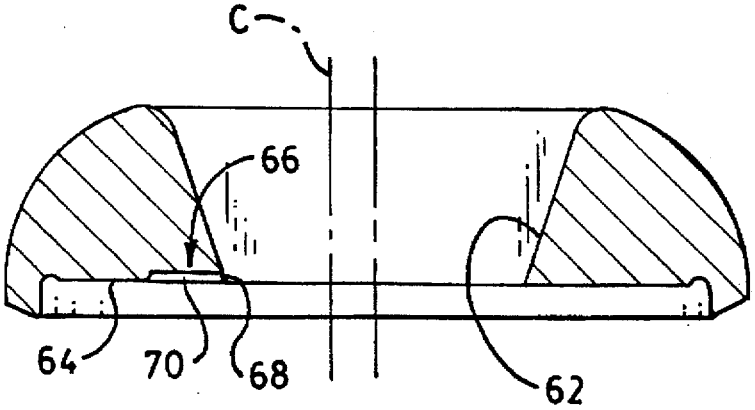
FIG. 3 is a sectional view of the swash plate taken along section plane III—III of FIG. 2.

The swash plate 22, as better seen in FIGS. 2 and 3, is stationary relative to the piston block 18 and has an inner peripheral surface 62 within which the drive shaft 16 is disposed and a control surface 64 against which the pistons 30 are engaged. A passageway 66 formed in the swash plate 22 has a first end 68 which opens through the inner peripheral surface 62 to the first chamber 14 and a second end 70 which opens though the control surface 64 and is alignable with each piston shoe passageway 40 when that piston shoe 34 passes thereby during operation of the pump 10. The passageway 66 has a leading edge 72 which is preferably arranged at or before the angular location of the leading edge 54. Such alignment generally occurs when the respective piston 30 is at about bottom dead center and the inlet port 42 fluidly communicates with the piston chamber 24 but must not first occur later than when inlet port 42 is in open fluid communication with the piston chamber 24.

The swash plate 22 may, as is well known in the art, be rotated about an axis C extending through a pair of circumferentially oppositely disposed trunnions 74 (as illustrated in FIG. 2) to a desired control angle B (as illustrated in FIG. 1). The control angle B is selected to control the pump's volumetric flow rate by regulating the length of the stroke for each piston 30 and necessitates the earlier described ball and socket connection joint between the plunger 32 and shoe 34 portions to ensure continuous engagement between the pistons 30 and the control surface 64.

While the passageway 66 is preferably circumferentially disposed at about the same angular location about axis A as the inlet port's leading edge 54 (best seen in FIG. 2), it is to be understood that passageway 66 and the inlet port's leading edge 54 may be arranged at any relative circumferential location if substantially simultaneous open fluid communication to piston chamber 24 is provided through passageway 66 and the inlet port 42. In any case, however, alignment of the passageway 66 with passageway 36 provides fluid communication and thus pressure equalization between the first chamber 14 and the piston chamber 24.

INDUSTRIAL APPLICABILITY

Although only one piston 30 and its associated structure such as piston chamber 24 will be discussed hereinafter, it is to be understood that there is typically a plurality (e.g. nine) of such pistons 30 and associated structure in any practical application of such variable displacement pump 10. During operation of the pump 10 when the piston 30 moves under the driving influence of the drive shaft 16 and swash plate 22 toward bottom dead center (i.e. towards the valve block 20), the pump's working fluid (often oil) is pumped from piston chamber 24 through the valve block outlet port 44 to a fluid utilizing apparatus (not shown). When, however, the piston 30 moves in the opposed direction (i.e. away from the valve block 20) under the driving influence of the drive shaft 16 and swash plate 22 during further rotation of the piston block 18 and associated structure about axis A in the direction D (FIG. 5), the pump's working fluid sequentially enters the expanding piston chamber 30 first through the secondary portion 48, subsequently through both the secondary portion 48 and the primary portion 46, and finally through the primary portion 46 only. Shortly after alignment obtains between the connection portion 28 and the inlet port 42, dramatic pressure oscillations can occur in the piston chamber 24 and undesirably promote working fluid cavitation at the valve block about the inlet port 42 and at the control surface 64. Heretofore, such cavitation often occurred resulting in damage to those areas of the pump. This invention has, however, substantially eliminated/prevented such cavitation by virtue of the swash plate passageway 66 passing working fluid between the first chamber 14 and the piston chamber 24 to maintain the pressure in the piston chamber 24 within a sufficiently narrow band to effectively suppress cavitation and the damage it causes.

Operationally, at about bottom dead center position of the piston 30, the piston chamber 24 moves about axis A into initial fluid communication with the inlet primary portion 46 and, upon initial exposure of the piston chamber 24 to the inlet port 42, the potential for working fluid cavitation is at a maximum. However, by limiting such initial exposure to the secondary inlet portion 48 which has greater fluid restriction than the inlet primary portion 46, the pressure oscillations normally encountered in the piston chamber 24 are more gradual. This effect, together with the fluid flow provided by passageway 66 reduces the pressure oscillations in the piston chamber 24 to substantially eliminate the potential for cavitation at the valve block 20 and the swash plate control surface 64

Other aspects, objects and advantages of this invention can be obtained from a study of the drawings, the disclosure and the appended claims.

I claim:

1. In a variable displacement pump having a drive shaft positioned within a first chamber, a swash plate having a control surface, a plurality of pistons disposed in respective piston chambers formed in a rotatable piston block and being in engagement with said control surface, and a valve block having an inlet and an outlet port which are each sequentially communicatable with each piston during piston rotation about an axis A, each piston having a passageway providing fluid communication between a respective piston chamber and the control surface, the improvement comprising:

said swash plate having a passageway for providing fluid communication between the first chamber and the piston chamber, said swash plate passageway having a leading edge; and each of said inlet and outlet ports having a secondary portion and a primary portion and each of said portions having a leading edge, each of said primary portions having a respective flow area per unit rotation about axis A at its leading edge of a first preselected magnitude and each of said secondary portions having a respective flow area per unit rotation about axis A at its leading edge of a second preselected magnitude, said second preselected magnitude being less than said first preselected magnitude.

2. A pump, as set forth in claim 1, wherein the piston includes a piston shoe having a passageway which is rotatably alignable with the passageway of the swash plate.

3. A pump, as set forth in claim 2, wherein said swash plate passageway is in a region of said swash plate substantially angularly corresponding to the leading edge of the inlet port's primary portion.

4. A pump, as set forth in claim 2, wherein each piston shoe passageway is alignable with the passageway of the swash plate when the piston is at about bottom dead center and the inlet port is in fluid communication with said piston's chamber.

5. A pump, as set forth in claim 1, wherein the angular location of the swash plate passageway's leading edge is not after the angular location of the leading edge of the inlet port's primary portion.

6. A pump, as set forth in claim 1, wherein the swash plate passageway communicates with the piston passageway across the control surface.

7. A pump, as set forth in claim 1, wherein the total flow area of the secondary portion is in the range of about 1.0 to 2.0 percent of the total flow area of the corresponding primary portion.

8. A pump, as set forth in claim 1, wherein said secondary portions each having a bounding, lower surface which extends from the secondary portion's leading edge toward the connected primary portion at an angle of inclination relative to the valve block's communicating surface, said angle of inclination being between 10 and 20 degrees.

9. A pump, as set forth in claim 1, wherein each said piston chamber includes a connection portion which is alignable with said inlet port, wherein said swash plate's leading edge begins at an angular location which is at least as early as said connection portion's leading edge passes said primary inlet portion's leading edge.

* * * * *